US005592766A

United States Patent [19]

Mygatt

[11] Patent Number: 5,592,766

[45] Date of Patent: Jan. 14, 1997

[54] CONTAINER LID/CLOSURE WITH PRINTED CLOSURE INSERT

[76] Inventor: Leonard T. Mygatt, 12791 Panorama Pl., Santa Ana, Calif. 92705

[21] Appl. No.: 484,957

[22] Filed: Jun. 7, 1995

[51] Int. Cl.[6] ..... G09F 3/20

[52] U.S. Cl. ..... 40/307; 40/311

[58] Field of Search ..... 40/307, 311, 324, 40/299, 661, 611

[56] References Cited

U.S. PATENT DOCUMENTS

| | | | |
|---|---|---|---|
| 863,721 | 8/1907 | Kannenberg . | |
| 1,215,114 | 2/1917 | Cohen . | |
| 2,015,028 | 9/1935 | Gillette | 40/307 |
| 2,050,487 | 8/1936 | Durrant | 40/307 |
| 2,129,406 | 9/1938 | Cole . | |
| 2,243,629 | 5/1941 | Hodgson . | |
| 2,766,796 | 10/1956 | Tupper | 40/324 X |
| 2,797,180 | 6/1957 | Baldanza | 40/324 X |
| 2,953,272 | 9/1960 | Mumford et al. . | |
| 3,204,359 | 9/1965 | Kurokawa | 40/307 |
| 3,257,021 | 6/1966 | Brockett . | |
| 3,421,653 | 1/1969 | Whaley . | |
| 3,773,207 | 11/1973 | Dokoupil et al. . | |
| 3,838,529 | 10/1974 | Aybar | 40/611 X |
| 4,006,839 | 2/1977 | Thiel et al. . | |
| 4,275,518 | 6/1981 | Martin | 40/324 |
| 4,389,802 | 6/1983 | McLaren et al. . | |
| 4,407,426 | 10/1983 | McLaren et al. . | |
| 4,691,501 | 9/1987 | King . | |
| 4,779,748 | 10/1988 | King . | |
| 5,100,012 | 3/1992 | Pacelli, Jr. . | |

FOREIGN PATENT DOCUMENTS

| | | | |
|---|---|---|---|
| 2596557 | 10/1987 | France | 40/611 |

*Primary Examiner*—Joanne Silbermann
*Attorney, Agent, or Firm*—Knobbe, Martens, Olson & Bear

[57] ABSTRACT

An improved container closure and printed matter insert. The closure includes a central recess for receiving the insert with an inwardly projecting flange for retaining the insert therein. The closure includes an outer skirt, a top wall, and an angled side wall defining the outer boundary of the central recess. The inwardly projecting flange does not extend above the top horizontal surface of the top wall, thus helping to prevent binding in assembly line. The insert is defined by a central circular disk portion and a plurality of outwardly extending tabs. The tabs are formed with lines of weakness along the peripheral outline of the central disk portion, to enable them to flex upward above the plane of the disk. The lines of weakness may be score lines or perforations. When inserted into the recess of the closure, the tabs of the insert conform to the angled side wall and extend approximately from the central floor to the inwardly extending retaining flange. The tabs are biased outward and helping to retain the insert within the recess, even if the closure is flexed.

31 Claims, 3 Drawing Sheets

CONTAINER LID/CLOSURE WITH PRINTED CLOSURE INSERT

FIELD OF THE INVENTION

The present invention relates to closures for containers and, more particularly, to an improved closure having a central circular recess for receiving a printed insert having outwardly extending retaining tabs.

BACKGROUND OF THE INVENTION

Containers or cartons with printed matter describing the contents therein are well known. Information about the contents of the container may be printed directly on the container or placed on a label which in turn is secured to the container. For instance, printed disk-shaped inserts are commonly placed in receptacles in the closures or lids of certain containers. One such arrangement is disclosed in U.S. Pat. No. 3,421,653 to Whaley.

U.S. Pat. No. 4,389,802 to McLaren, et al., discloses a scalloped-edge paperboard insert for use with a plastic lid. The circular plastic lid includes a substantially flat top surface and an upwardly and inwardly projecting circular bead thereon. The diameter of the circle defined by the outermost points of the scalloped-edge insert is greater than the diameter of the circle defined by the upwardly and inwardly projecting bead of the lid. This configuration facilitates the retention of the insert in the lid.

A similar prior art lid and insert combination is shown in FIGS. 1 and 2. This plastic lid is manufactured by Packer Plastics, Inc., of Lawrence, Kans. FIG. 1 illustrates the lid 20 having a central recess for receiving a generally circular, scalloped-edge insert 24. The edge of the insert 24 includes alternating nodes 26 and indents 28 to define the scalloped shape. The lid 20 further comprises an outer vertical skirt 32, a horizontal top wall 34, and an inner vertical wall 36 adjacent a central planar panel 30. The central panel 30 and circumferential inner wall 36 define the central recess 38 for receiving the insert 24. An angled flange 40 extends upwardly and radially inwardly from the intersection point of the top wall 34 and inner wall 36. The flange 40 defines a circle along its uppermost edge which is smaller in diameter than the circle defined by the nodes 26 of the insert 24. Thus, the insert 24 can be pressed into the recess 36 and held therein by the angled flange 40. However, due to the relatively loose fit provided by the vertical inner wall 36, the insert 24 is prone to popping out from the recess 38 if the lid 20 is flexed to any great extent, such as when the lid is manually removed from the container, or when the lid is automatically placed on the container during manufacturing processes.

To secure the closure to the containers during manufacture, high-speed automated capping machinery is often used, such as that shown in U.S. Pat. No. 4,691,501, which is hereby incorporated by reference. In a typical automated capping machine, the lids 20 are stacked on a pair of substantially parallel and generally horizontally disposed rods over a horizontal row of conveyed containers. One by one, the lids are fed downward through a chute and mated with uncapped containers. Before dropping through the chute, the lids must be separated mechanically or with jets of air and the angled flange 40 sometimes catch on an adjacent lid, wherein two lids may fall into the chute causing a binding of the machine. Each vertically oriented lid is guided from the bottom of the chute so that a lower edge contacts the leading edge of a container, whereupon a roller flexes and re-orients the lid horizontally to cap the container. When the printed insert is placed in the recess on the lid shown in FIGS. 1 and 2 of McLaren, et al., before the lid passes through the automated capping device, the insert is prone to popping out due to the flexure of the lid during the capping step. This undesirably slows the capping process.

There is thus a need for a more reliable configuration of a printed disk insert and plastic closure combination which reliably retains the insert in place.

SUMMARY OF THE INVENTION

In response to the drawbacks noted above, the present invention is an improved container lid or closure and associated printed insert. The closure and insert are designed so as to more reliably retain the insert within a recess in the closure. More specifically, the closure includes a retaining flange surrounding the upper side walls of a central recess in the closure. The insert is flexible and includes a main body portion and a number of tabs extending outward therefrom. The retaining flange defines a radially inner periphery smaller than the main body of the insert, which can be flexed as it is pushed past the flange into the recess. The tabs also flex as the insert is pushed into the recess. The insert main body is sized to lie flat on the floor of the recess while just fitting within the side walls. A portion of the side walls of the recess are angled upward and radially outward. The tabs bend to conform to the angled side walls and extend upward into contact with the retaining flange, thus preventing the insert from lifting out of the recess. Preferably, the tabs are formed by scoring the underside of the insert and are biased outward toward the recess side walls. Additionally, the retaining flange is formed by an undercut so as to extend radially inward and flush with a top wall of the closure. The smooth, planar top wall facilitates use of the closure in automated capping machinery.

In one embodiment, the present invention comprises a container closure and insert combination including a closure having a recess in an upper surface. The recess is defined by a central horizontal floor and an upwardly and radially outwardly angled surrounding wall. An insert retaining flange projects inwardly from an upper end of the surrounding wall. The generally planar insert includes a plurality of outwardly extending tabs from a main body portion, the main body having a periphery sized to closely fit within the confines of the retaining flange. The tabs are capable of flexing upward out of the plane of the main body. The tabs are sized to extend upward and outward from the main body along the surrounding wall and are biased outward causing the tabs to engage the surrounding wall and retain the insert within the recess. The insert preferably includes lines of weakness generally at the intersection of the main body and the tab so that the tabs may more easily flex upwards out of the plane of the main body. In one embodiment, the lines of weakness are score lines formed in the undersurface of the insert.

In a further aspect of the present invention, an improved closure is provided for a container, the closure having a planar top wall and an outer generally vertical skirt depending downwardly from the periphery of the top wall and adapted to removably engage the container. A central recess defined by a planar panel or floor spaced below the top wall is sized to receive a printed insert supported on the floor. A surrounding flange is directed inwardly into the recess from the top wall so as not to protrude above the plane of the top wall. The flange is adapted to retain an insert within the recess.

The closure of the present invention preferably includes a side wall connected to the top wall and the floor of the recess, and angled inwardly from an upper end to a lower end. The flange is preferably formed as an undercut in the top wall and has a lower surface angled outward to join with the side wall. The top wall includes a step formed at an outermost periphery sized to receive a lower end of a skirt of a second closure for stacking thereupon.

In accordance with a further aspect of the present invention, a combination of a container having an upper rim and a flexible closure sized to fit over the rim is provided. A central recess is formed in an upper surface of the closure and is adapted to receive a flexible planar insert. The recess is defined by a lower horizontal floor and a surrounding wall. A flange surrounds the recess and extends inwardly from the upper end of the wall. A closure insert is provided having a main body sized to lie flat on the floor and a plurality of retaining tabs extending outward from the main body. The retaining tabs are adapted to flex upward along the wall between the floor and the flange to retain the insert within the recess. The wall is angled outward from a lower end adjacent the floor to an upper end adjacent the flange.

DESCRIPTION OF THE PREFERRED EMBODIMENTS

Figure 1:
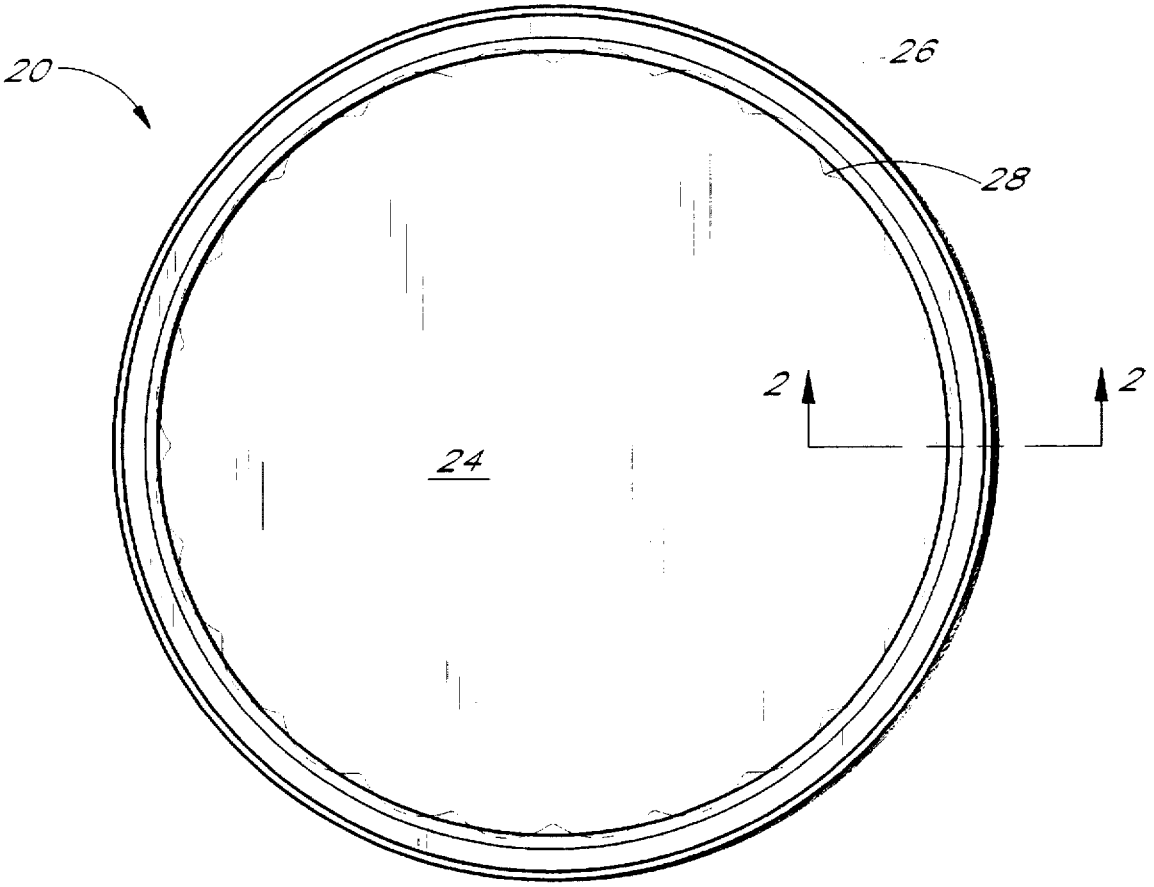
FIG. 1 PRIOR ART
FIG. 1 is a top plan view of a plastic closure of the prior art having an insert in a central recess therein.
Figure 2:
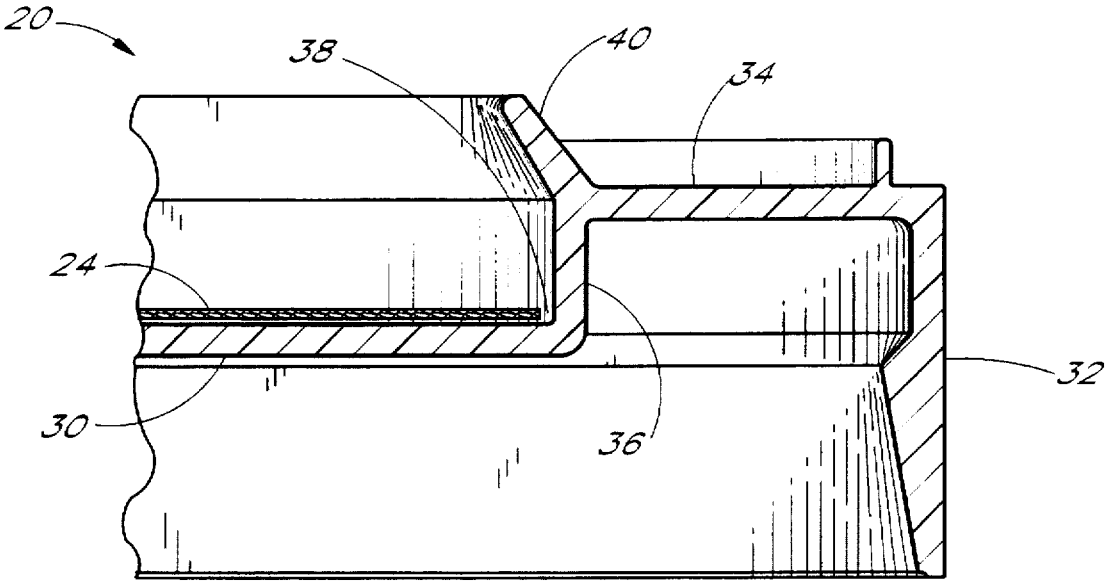
FIG. 2 PRIOR ART
FIG. 2 is a cross-sectional view of a peripheral rim of the prior art closure and insert taken along line 2—2 of FIG. 1.
Figure 3:
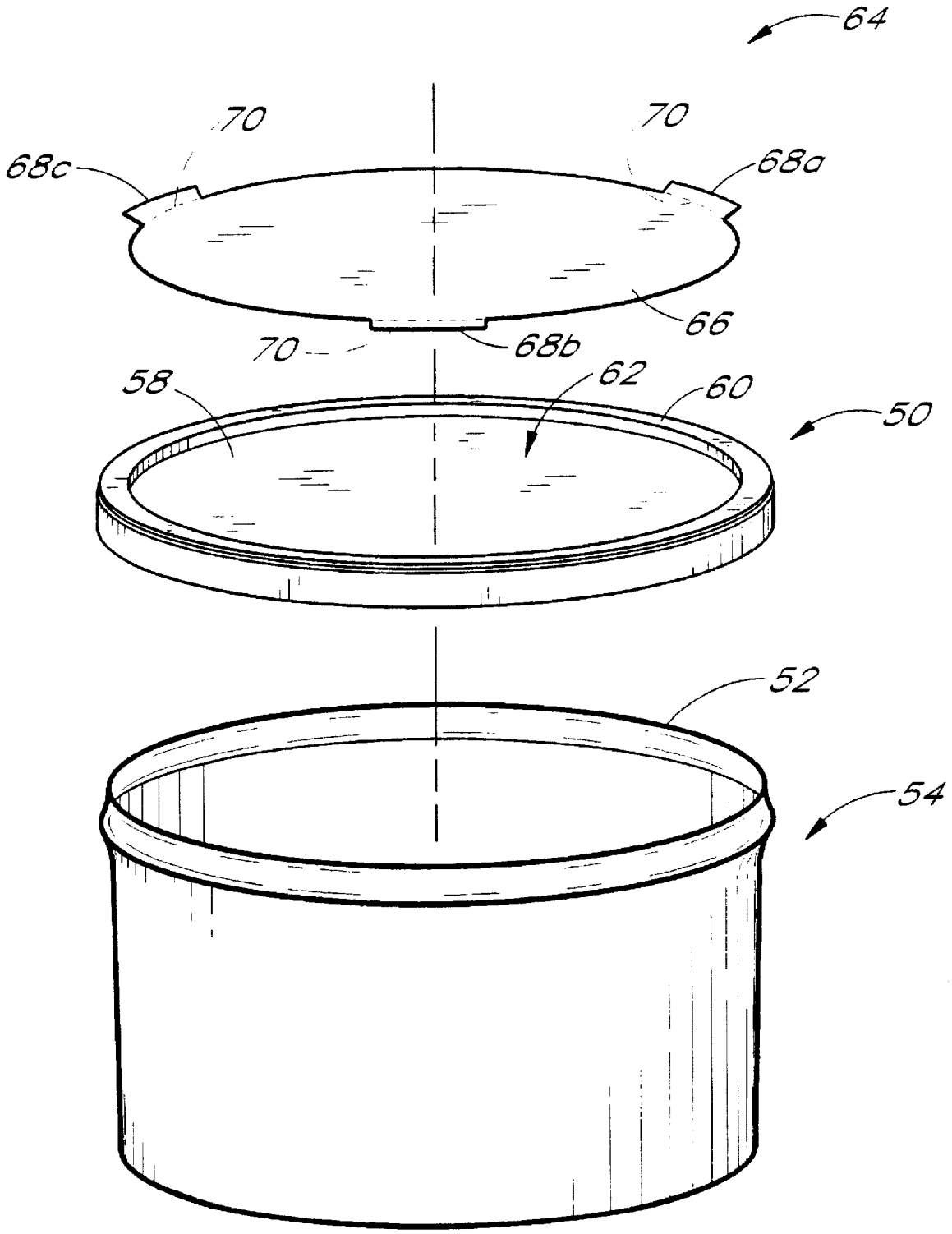
FIG. 3 is a perspective exploded view of a preferred container closure and insert of the present invention.

FIG. 3 illustrates an improved plastic lid or closure 50 of the present invention adapted to be coupled over an upper rim 52 of a container 54. Although the closure 50 and container 54 are illustrated as circular in plan view as is typical, it should be understood that the present invention could equally be adapted to any desired shape of container, such as, for example, oval or generally rectilinear.

The closure 50 includes a central planar circular floor 58 depressed below a peripheral top wall 60 to define a central recess 62. A thin, planar insert 64 is sized to fit within the recess 62. The insert 64 may be constructed of paperboard or other suitable material on which information regarding the product packaged in the container can be printed.

Figure 4:
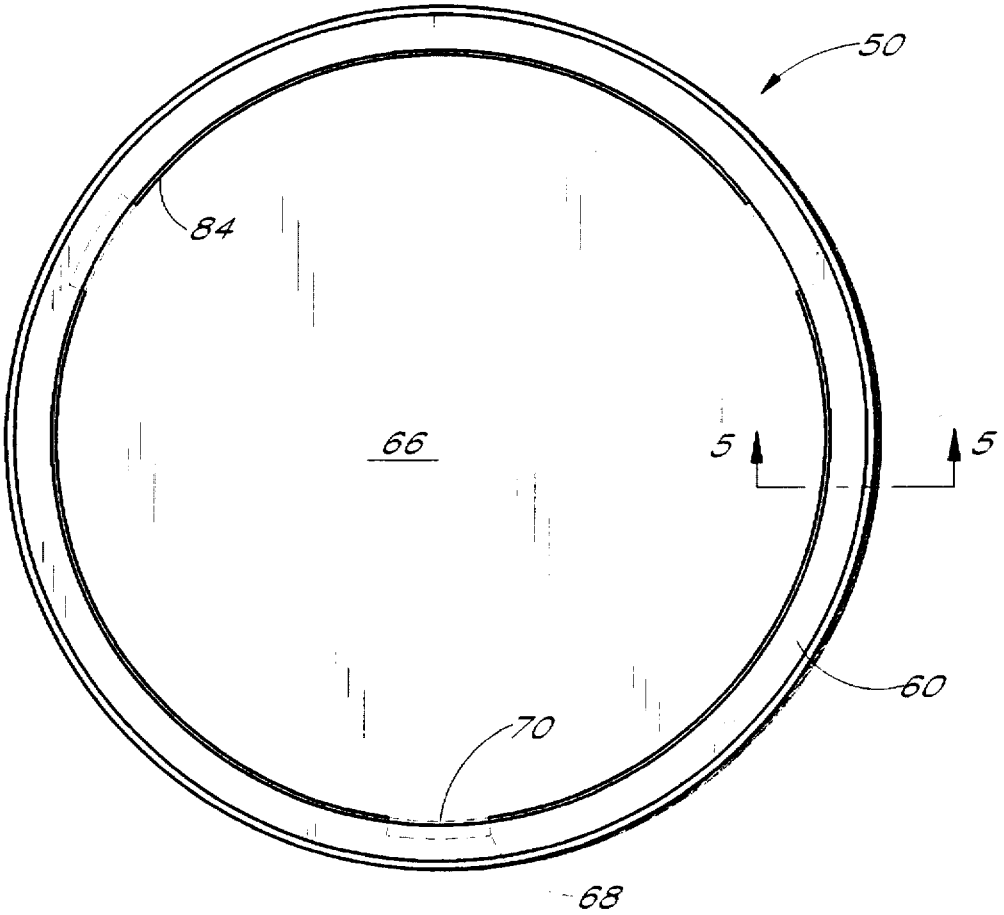
FIG. 4 is a top plan view of the closure and insert of FIG. 3.

With reference to FIGS. 3 and 4, the insert 64 includes a central, circular disk-shaped body 66 and a plurality of outwardly projecting retaining tabs 68. In the illustrated embodiment, there are three tabs, 68*a*, 68*b*, and 68*c*. The tabs 68 are integrally formed with the disk-shaped body 66. The tabs 68 can be flexed upwardly relative to the central body 66 by virtue of lines of weakness 70 formed generally along the peripheral circle defined by the central body 66.

The lines of weakness 70 allow the tabs 68 to more easily flex out of the plane of the body 66. In one particular embodiment, the lines of weakness 70 comprise score lines on the undersurface of the insert at the intersection of the tabs 68 and body 66. The score lines 70 may be continuous along the intersection of the tabs 68 and body 66, or may be interrupted or otherwise discontinuous. In another form, the lines of weakness 70 may be perforations through the insert 64.

By forming the score lines 70 on the underside of the insert 64, the tabs 68 are hinged so as to flex upward, but are biased downward to lie in the plane of the main body 66. The bias is created by the stresses in the arcuate "hinge" connection between the tabs 68 and main body 66 when the tabs are flexed upward. The downward bias causes the tabs 68 to press outward against a side wall 74 of the recess 62, as can be seen best in FIG. 5. The side wall 74 defines the outer boundaries of the recess 62.

Figure 5:
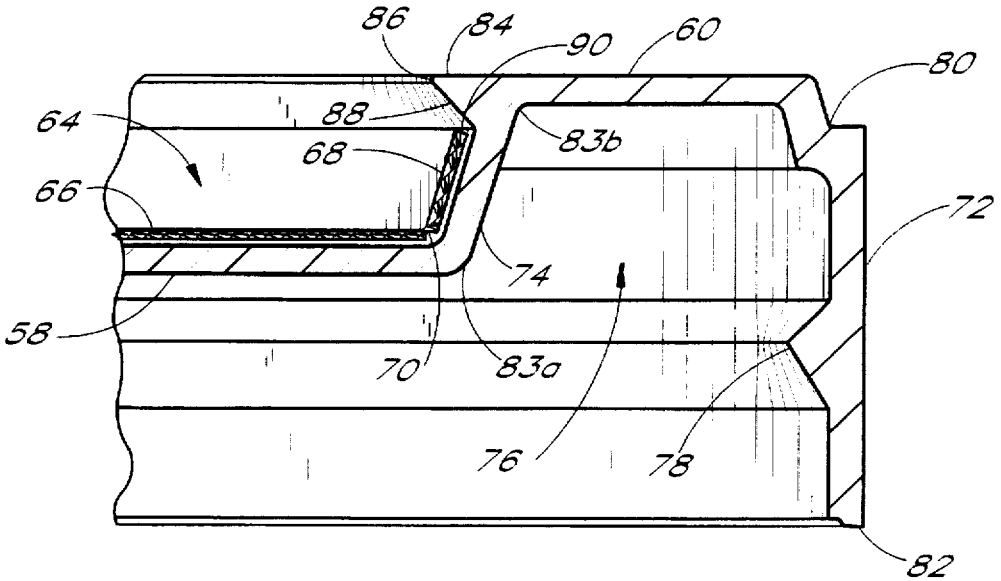
FIG. 5 is a cross-sectional view of a peripheral rim of the closure and insert of the present invention taken along line 5—5 of FIG. 4.

Now with reference to FIG. 5, the closure 50 further comprises an outer vertical skirt 72 having an annular bead 78 formed on its inner surface for retaining the closure 50 on an outer bead (not shown) of the container 54. The combination of the outer skirt 72, top wall 60, and angled side wall 74 defines a downwardly opening container rim receiving recess 76. An exterior step 80 is formed between the skirt 72 and top wall 60 to enable a number of closures 50 to be stacked together. More particularly, the lower edge 82 of the skirt 72 of one closure in a stack is positioned in the step 80 of a closure below.

As previously mentioned, the central recess 62 is defined by the central circular floor 58 and the angled side wall 74. The angled side wall 74 includes a lower end 83*a* adjacent the floor 58 extending upward and outward to an upper end 83*b* joining with the top wall 60. An inwardly extending flange 84 defines an insert retaining structure for the recess 62. References to "inner" and "outer" pertain to the radial directions relative to the generally circular closure 50 and insert 64. The flange 84 extends horizontally inward from the top wall 60 without projecting above the planar top surface thereof. The flange 84 is thus formed as an undercut from the recess 62 into the top wall 60. The flange 84 terminates in an innermost circular edge 86 and continues downward and outward to the angled side wall 74 along an angled surface 88. The surface 88 makes an approximately 45° down and radially outward angle with the vertical to join with said side wall 74. Thus, the flange 84 has a generally triangular cross-section, with an apex formed by the circular edge 86.

The periphery of the body 66 has approximately the same shape and the same dimensions as the circular edge 86, so as to fit easily within the recess 62. The tabs 68 are flexible and can be bent upward to allow the insert 64 to be easily pressed past the flange 84 into the recess 62. When inserted, the main body 66 lies flat in the floor 58 of the recess 62 and the tabs 68 conform to the angled side wall 74.

The present closure 50 more securely retains the insert 64 by virtue of the angled side wall 74 and the outwardly extending tabs 68 of the insert. More particularly, as seen in FIG. 5, the lines of weakness 70 formed in the insert 64 allow the tabs 68 to bend upward from the plane of the central body 66 to conform to the angle of the recess side wall 74. This provides a structural restriction to movement of the insert 64 in a vertical direction. In other words, the main body 66 lies flat on the floor 58. The radial dimension of the tabs 68 is such that they extend along nearly the entire length of the inner surface of the angled side wall 74. Thus, the top end 90 of each tab 68 contacts the angled surface 88 of the flange 84 with the central body 66 flat on the floor 58. Furthermore, as mentioned above, the tabs 68 are biased downward and outward into engagement with the side wall 74. This arrangement reliably maintains the central disk portion 66 of the insert 64 proximate the floor 58, and the insert 64 will be more securely retained within the recess 62 of the closure 50 when the closure flexes.

A further advantage of the present closure 50 is the provision of an insert retaining flange 84 which does not project above the planar top surface of the top wall 60. In the manufacturing process, a multitude of closures 50 will be conveyed in a stack by automated capping machinery which joins the closures with uncapped containers 54 filled with various products. The closures 50 must be individually separated from the stack in order to be placed on the container. An example of such an automated capping machine is shown in U.S. Pat. No. 4,691,501. Closures of the prior art have upwardly projecting insert retaining flanges tend to catch on each other, thus inhibiting separation of individual closures from the stack. When this occurs, the automated machinery typically must be halted, resulting in lost productivity. The present closure 50, on the other hand, by virtue of the flat top wall 60, is easily separated from adjacent closures and will smoothly and reliably travel through the machinery with a greatly reduced potential of binding.

Another advantage of the present closure 50 is the capacity to place the insert 64 into the recess 62 prior to the container capping step. More particularly, the automated capping machinery typically relies on a roller to press each closure onto an uncapped container resulting in a pronounced flexing of the closure. Prior closures retained the inserts rather loosely in the recess rendering them susceptible to the inserts popping out when the closure was inordinately flexed, and necessitating the placement of the insert into the closure only after the capping step. By virtue of the outwardly directed retaining tabs 68 of the insert 64 in conjunction with the preferred angled side wall 74 and flange 84 of the closure 50, the present invention more reliably maintains the insert on closures subjected to flexing during the capping step. The capability to place the inserts 64 prior to the capping step greatly increases the flexibility of the assembly process.

In one embodiment of the present closure 50, the side wall 74 makes an angle of approximately 15 degrees with the horizontal floor 58. From the point of intersection with the side wall 74, the surface 88 makes an angle of approximately 45 degrees with the vertical. Furthermore, the vertical height of the flange 84 is approximately 0.045 inches. The radial width of the flange 84 is approximately 0.035 inches, as measured from the point of intersection of the angled wall 88 with the side wall 74 to the innermost edge 86. The recess 62 may have a depth of approximately 0.137 inches.

Preferably, the closure 50 is injection molded from a thermosetting polymer, such as polyethylene. The closures 50 are molded within a one-piece mold cavity and a one-piece mold core. The walls of the mold cavity form the external surface of the closure 50, and the walls of the mold core form the internal surface of the lid. Such a mold apparatus is shown in U.S. Pat. No. 4,691,501. The mold cavity and mold core are fitted together and the space therebetween is injected with a thermosetting polymer. Normally the injection point is in the mold cavity, or at the top center of the closure recess. In the present invention, however, the injection point is in the mold core, or on the underside of the recess 62. This configuration facilitates the ejection of the closure from the undercut mold halves and eliminates the need for cam-action tooling to mechanically eject the closure from the mold halves, despite the presence of two undercuts; one formed by the flange and one by the bead on the skirt. Those skilled in the art will recognize the advantage of doing away with the need for cam-action tooling.

Although this invention has been described in terms of certain preferred embodiments, other embodiments that are apparent to those of ordinary skill in the art are also within the scope of this invention. Accordingly, the scope of the invention is intended to be defined by the claims that follow.

I claim:

1. A container closure and insert combination, comprising:

a closure having an upper surface which faces away from the container when the closure is removably secured thereupon, said closure having a recess formed in said upper surface and defined by a horizontal floor and an upwardly and radially outwardly angled wall surrounding the periphery of the floor;

a skirt depending downwardly from the outer periphery of said closure, said skirt adapted to removably engage a container;

a flange projecting inwardly from an upper end of said surrounding wall;

a product label insert having a main body with a peripheral edge, and an extension portion extending outwardly from the peripheral edge of said insert main body and captured by said flange, said extension portion being flexibly attached to the main body and sized to extend upward and outward from the plane of said main body, said extension portion being biased downward into engagement with said outwardly angled wall so that said flange retains said insert within said recess.

2. The combination of claim 1, wherein said closure and said insert are circular.

3. The combination of claim 1, wherein said extension portion comprises multiple discrete tabs.

4. The combination of claim 1, wherein said main body is generally planar, and said insert includes lines of weakness generally along the intersection of said main body with said extension portion so that the extension portion may more easily flex upward out of the plane of said main body.

5. The combination of claim 4, wherein said lines of weakness are perforations.

6. The combination of claim 4, wherein said lines of weakness are score lines.

7. The combination of claim 6, wherein said score lines are continuous.

8. The combination of claim 6, wherein said score lines are discontinuous.

9. The combination of claim 6, wherein said score lines are formed in an underside of said insert.

10. A closure for a container, comprising:

a planar top wall forming an uppermost surface on said closure;

an outer generally vertical skirt depending downwardly from the periphery of said top wall, said skirt adapted to removably engage a container;

a recess having a substantially planar floor surrounded by and spaced below said top wall;

a recess side wall connecting said recess floor and said top wall, the top wall having a sufficient width to space said skirt and said side wall for engaging said container; and a flange directed inwardly into said recess from said top wall, said flange being positioned so as not to protrude above the plane of said top wall for retaining an insert within said recess.

11. The closure of claim 10, further comprising:

a side wall connected at an upper end to said top wall and connected at a lower end to said floor, said side wall lower end being angled radially inwardly.

12. The closure of claim 10, including a step formed at the outermost periphery of said top wall sized to receive a lower end of a skirt of an identical closure for stacking thereon.

13. The closure of claim 10, wherein said flange is formed as an undercut in said top wall, said flange having a lower angled surface joined to said side wall, said lower angled surface extending downwardly and radially outward toward said side wall.

14. The closure of claim 10, wherein said flange has a generally triangular cross-section with an apex forming a radially inner edge.

15. The closure of claim 10, wherein said flange defines a portion of said side wall.

16. An apparatus, comprising:

a container having an opening;

a flexible closure sized to removably cover said container opening;

a recess in an upper surface of said closure adapted to receive a flexible planar insert, said recess being defined by a lower horizontal floor and a surrounding wall;

a flange surrounding said recess and extending inwardly from said surrounding wall; and an insert having a main body sized to lie flat on said floor and a plurality of retaining tabs extending outward from said main body and adapted to flex relative to the plane of said main body so that said tabs lie adjacent said wall between said floor and said flange to retain the insert within the recess.

17. The apparatus of claim 16, wherein said wall is angled outward from a lower end adjacent said floor to an upper end adjacent said flange.

18. The apparatus of claim 16, wherein said insert includes lines of weakness generally along the intersection of said main body with said tabs so that the tabs may more easily flex upward out of the plane of the main body.

19. The apparatus of claim 18, wherein said lines of weakness are score lines.

20. The apparatus of claim 17, wherein said score lines are formed in an underside of said insert to enable said tabs to extend upward and outward from the plane of said main body along said surrounding wall while creating a downward bias to said tabs.

21. A closure for a container, comprising:

an upper surface which faces away from the container when the closure is removably secured thereupon;

a recess in said upper surface defined by a floor and an upwardly and radially outwardly angled side wall at the periphery of the floor;

a flange projecting inwardly from an upper end of said side wall and having a lower surface angled downward and outward to join with said upwardly and outwardly angled side wall; and an insert having a main body defined by a periphery which is sized to closely fit within the confines of said side wall.

22. The closure of claim 21, further comprising a plurality of tabs extending outwardly from the periphery of said insert main body, said tabs being flexibly attached to the main body and sized to extend upward and outward from said main body along said side wall, but biased downward, causing said tabs to engage said outwardly angled wall so that said flange retains said insert within said recess.

23. A container closure and insert combination, comprising:

a closure having an upper surface which faces away from the container when the closure is removably secured thereupon, said closure having a recess formed in said upper surface and defined by a horizontal floor and an upwardly and radially outwardly angled wall surrounding the periphery of the floor;

a flange projecting inwardly from an upper end of said surrounding wall;

a planar insert which is adapted to be printed upon, said inset having a main body defined by a periphery which is sized to closely fit within said recess; and a plurality of tabs extending outwardly form the periphery of said insert main body, said tabs being flexibly attached to the main body and sized to extend upward and outward from the plane of said main body, said tabs being biased downward into engagement with said outwardly angled wall so that the tabs may more easily flex upward out of the plane of the main body.

24. The combination of claim 23, wherein said lines of weakness are perforations.

25. The combination of claim 23, wherein said lines of weakness are score lines.

26. The combination of claim 25, wherein said score lines are continuous.

27. The combination of claim 25, wherein said score lines are discontinuous.

28. The combination of claim 25, wherein said score lines are formed in an underside of said insert.

29. A closure for a container, comprising:

an upper surface which faces away from the container when the closure is removably secured thereupon;

a recess in said upper surface defined by a central generally planar floor and an upwardly and radially outwardly angled side wall at the periphery of the floor;

a flange projecting inwardly from an upper end of said side wall and having a lower surface angled downward and outward to join with said upwardly and outwardly angled side wall;

a planar insert having a main body defined by a periphery which is sized to closely fit within the confines of said side wall; and a plurality of tabs extending outwardly from the periphery of said insert main body, said tabs being flexibly attached to the main body and sized to extend upward and outward from the plane of said main body along said side wall, but biased downward, causing said tabs to engage said outwardly angled side wall so that said flange retains said insert within said recess.

30. A closure for a container, comprising:

a planar top wall forming an uppermost surface on said closure and having an inner and outer periphery;

an outer skirt depending downwardly from the outer periphery of said top wall, said skirt adapted to removably engage a container rim;

a central recess having a floor spaced below said top wall;

a product label insert captured within said recess, said insert having a main body defined by a periphery sized to fit within said recess;

a recess side wall connected at an upper end to the inner periphery of said top wall and at a lower end to said floor, said side wall having a portion angled downwardly and radially outwardly from said top wall to an outermost periphery.

31. The closure of claim 30, wherein the projected inner periphery of said top wall is within the boundary of the outermost periphery of said side wall.

* * * * *

UNITED STATES PATENT AND TRADEMARK OFFICE

CERTIFICATE OF CORRECTION

PATENT NO. : 5,592,766

DATED : January 14, 1997

INVENTOR(S) : Leonard T. Mygatt

It is certified that error appears in the above-indentified patent and that said Letters Patent is hereby corrected as shown below:

On cover sheet of patent, please add Item [73],
-- Assignee: National Packaging Associates, Corp., Garden Grove, California --

Signed and Sealed this

Eighth Day of July, 1997

Bruce Lehman

*Attest:*

BRUCE LEHMAN

*Attesting Officer*

*Commissioner of Patents and Trademarks*